US006145435A

United States Patent [19]

Richards

[11] Patent Number: 6,145,435

[45] Date of Patent: Nov. 14, 2000

[54] WEB-FED ROTARY PRINTING PRESS AND METHOD FOR SIMULTANEOUSLY PRINTING TWO WEBS

[75] Inventor: John Sheridan Richards, Barrington, N.H.

[73] Assignee: Heidelberger Druckmaschinen AG, Heidelberg, Germany

[21] Appl. No.: 08/975,387

[22] Filed: Nov. 20, 1997

[51] Int. Cl.[7] ..... B41F 5/00

[52] U.S. Cl. ..... 101/180; 101/220

[58] Field of Search ..... 101/180, 221, 101/222, 219, 181

[56] References Cited

U.S. PATENT DOCUMENTS

| | | | |
|---|---|---|---|
| 410,576 | 9/1889 | Clause | 270/4 |
| 724,459 | 4/1903 | Firm | 101/180 |
| 1,310,658 | 7/1919 | Hope | 101/180 |
| 1,972,494 | 9/1934 | Roesen | 101/180 |
| 2,504,021 | 4/1950 | Heinrich | 101/180 |
| 3,026,106 | 3/1962 | Bouldin | 101/180 |
| 4,281,595 | 8/1981 | Fujishiro | 101/180 |
| 4,412,490 | 11/1983 | Grosshauser | 101/219 |
| 4,437,402 | 3/1984 | Fischer | 101/181 |
| 5,907,997 | 6/1999 | Jackson et al. | 101/180 |

FOREIGN PATENT DOCUMENTS

| | | | |
|---|---|---|---|
| 2377888 | 9/1978 | France | 101/181 |
| 2 275 019 | 8/1994 | United Kingdom . | |

*Primary Examiner*—John S. Hilten
*Assistant Examiner*—Amanda B. Sandusky
*Attorney, Agent, or Firm*—Kenyon & Kenyon

[57] ABSTRACT

A web-fed rotary printing press (1) which, in a first mode of operation, simultaneously prints on first and second webs (10, 18) and, in a second mode of operation, prints on a third single web (30) comprises at least one blanket-to-blanket printing unit (**2*a*, 2*b*, 2*c*) to which, in the second mode of operation, the third single web is fed to be printed on both sides and to which, in the first mode of operation, the first and second webs (10, 18) are fed arranged on top of each other so that a first side (8*a*) of the first web (8) and a second side (16*b*) of the second web are printed on. The printing press (1) further comprises first and second further printing units (20, 22) located downstream of the blanket-to-blanket printing unit (2) and first guiding means (24) for, in the first mode of operation, guiding the first web (10) around the first further printing unit (20) and second guiding means (26) for guiding the second web (18) around the second further printing unit (22**).

19 Claims, 3 Drawing Sheets

WEB-FED ROTARY PRINTING PRESS AND METHOD FOR SIMULTANEOUSLY PRINTING TWO WEBS

FIELD OF THE INVENTION

The invention is related to a web-fed rotary printing press and a method for simultaneously printing two webs in a web-fed rotary printing press. More specifically, the present invention relates to a web-fed rotary printing press for simultaneously printing a multi-color image on a first and a second web in a first mode of operation and for printing a multi-color image on both sides of a third single paper web in a second mode of operation.

BACKGROUND OF THE INVENTION

From the M600, M1000 and M3000-series printing presses, which are manufactured and sold by the applicant, it is known to print on both sides of a single paper web with a respective multi-color image, e.g. a 4-color-image. The multi-color images are applied to both sides of the single web by commonly used "blanket-toblanket" printing units through which the web is passed.

However, the above-described printing presses do not allow simultaneous printing on two paper webs of a multi-color image and a single color image on opposite sides of each web as is often desired, particularly in printing newspapers. Thus although these presses provide high print quality and a comparatively high speed in printing multi-color images on both sides of the single web, they can not run increased speed, high quality printing jobs in which a multi-color image is printed on one side and a single color image is printed on the other side of a web.

SUMMARY OF THE INVENTION

Having outlined the state of the art and its attendant disadvantages it is accordingly an object of the present invention to provide for a web-fed rotary printing press capable of printing multi-color images on both sides of a single paper web, and which alternatively allows simultaneous printing on two paper webs with a multi-color image on one side of each web.

According to a first embodiment of the invention, a web-fed rotary printing press, preferably a lithographic newspaper printing press, for simultaneously printing a first and a second web in a first mode of operation and alternatively printing a third single web in a second mode of operation comprises at least one blanket-to-blanket printing unit to which the first and second webs are fed on top of each other for printing on a respective first side of the first web and a respective second side of the second web in the first mode of operation, and to which alternatively the third single web may be fed to be printed on both sides in the second mode of operation. The printing press further comprises a first further printing unit and a second further printing unit, first guiding means for guiding the first web around said first further printing unit and second guiding means for guiding the second web around said second further printing unit in the first mode of operation.

According to an exemplary embodiment of the invention, at least two further blanket-to-blanket printing units are provided with each of the blanket-to-blanket printing units applying a different image of one of the colors yellow, magenta, cyan and black to the first and second sides of the webs processed in the first and second modes of operation.

According to a further embodiment of the invention, the first and second further printing units, in a first mode of operation, apply a single-color image, preferably a black image, to the respective first and second sides of the second web and to the respective first and second sides of the first web.

Pursuant to another exemplary embodiment of the invention, the first and second further printing units are imprinter printing units for printing varying or changing images on the respective sides of the first and second webs.

According to a further embodiment of the invention third guiding means, which may preferably be known rollers, are positioned upstream of the first blanket-to-blanket printing unit to arrange the first and second webs on top of each other, before feeding them as a superposed web to the first blanket-to-blanket printing unit.

According to a further embodiment of the invention, the first and the second webs may have different widths.

In another exemplary embodiment of the invention, the blanket-to-blanket printing units and the first and second further printing units are arranged such that the first and second webs or, alternatively, the third web are traveling in a substantially vertical direction. However, it is also possible to arrange the printing units such that the webs are traveling in a substantially horizontal direction.

According to a further embodiment of the invention, a method for simultaneously printing a first and a second web in a web-fed rotary printing press, preferably a lithographic newspaper printing press, comprises the steps of arranging the first and second webs on top of each other and then feeding them to a blanket-to-blanket printing unit for printing a first colored image on a first side of the first web and a second colored image on a second side of the second web. The first and second webs are then separated from each other and a third image is printed on a second side of the first web and a fourth image is printed on a first side of the second web. In this embodiment of the invention, the third and fourth images are preferably printed in first and second printing units arranged downstream of the blanket-to-blanket printing unit with the first web being guided around the first further printing unit and the second web being guided around the second further printing unit.

It is an advantage of the present invention that it allows printing of one so called 4/4-printing job in a first mode of operation, and alternatively allows printing, in a single job, one so called 4/1 and one so called 1/4 in a second mode of operation with twice the page production rate.

It is a further advantage of the present invention that realization of the invention requires only minor modifications to known web-fed printing presses, e.g. lithographic web-fed printing presses for directly applying a colored image to a running paper web, having more than three blanket-to-blanket printing units.

The present invention together with additional objects and advantages thereof will be best understood from the following description of specific embodiments, when read in connection with the accompanying drawings, in which.

DETAILED DESCRIPTION

Figure 1:
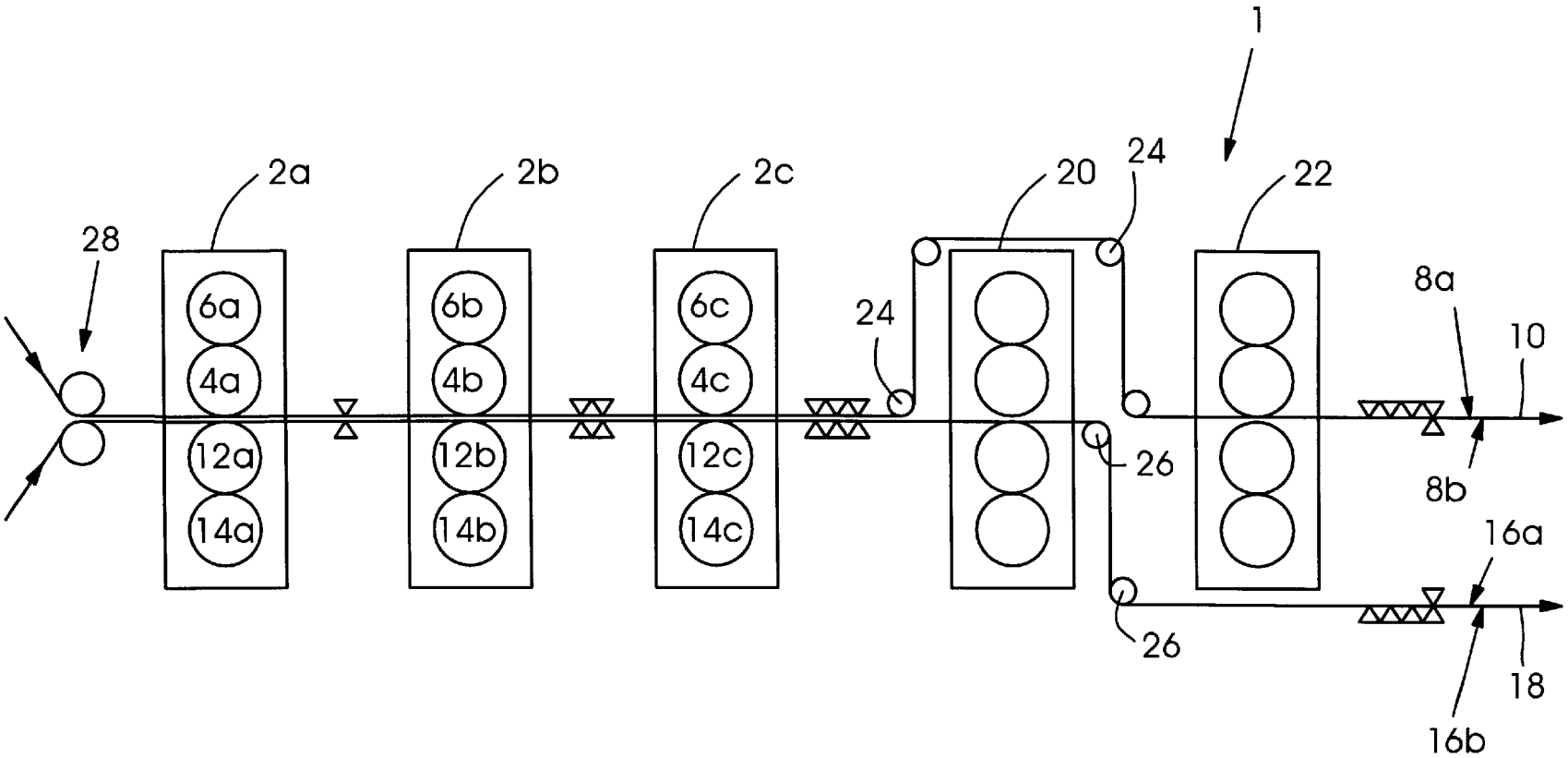
FIG. 1 shows a schematic view of a lithographic web-fed rotary printing press according to the present invention having three blanket-to-blanket printing units and two additional further printing units, when printing a 4/1-printing job on two different webs in a first mode of operation.

As shown in FIG. 1, a web-fed rotary printing press, in particular a lithographic rotary printing press for printing newspapers, comprises a variety of known blanket-to-blanket printing units 2*a*, 2*b*, 2*c* each of which has a first blanket cylinder 4*a*, 4*b* and 4*c*, respectively, and associated first plate cylinders 6*a*, 6*b* and 6*c*, respectively, for printing a first multi-color image on a first side 8*a* of a first web 10.

Figure 2:
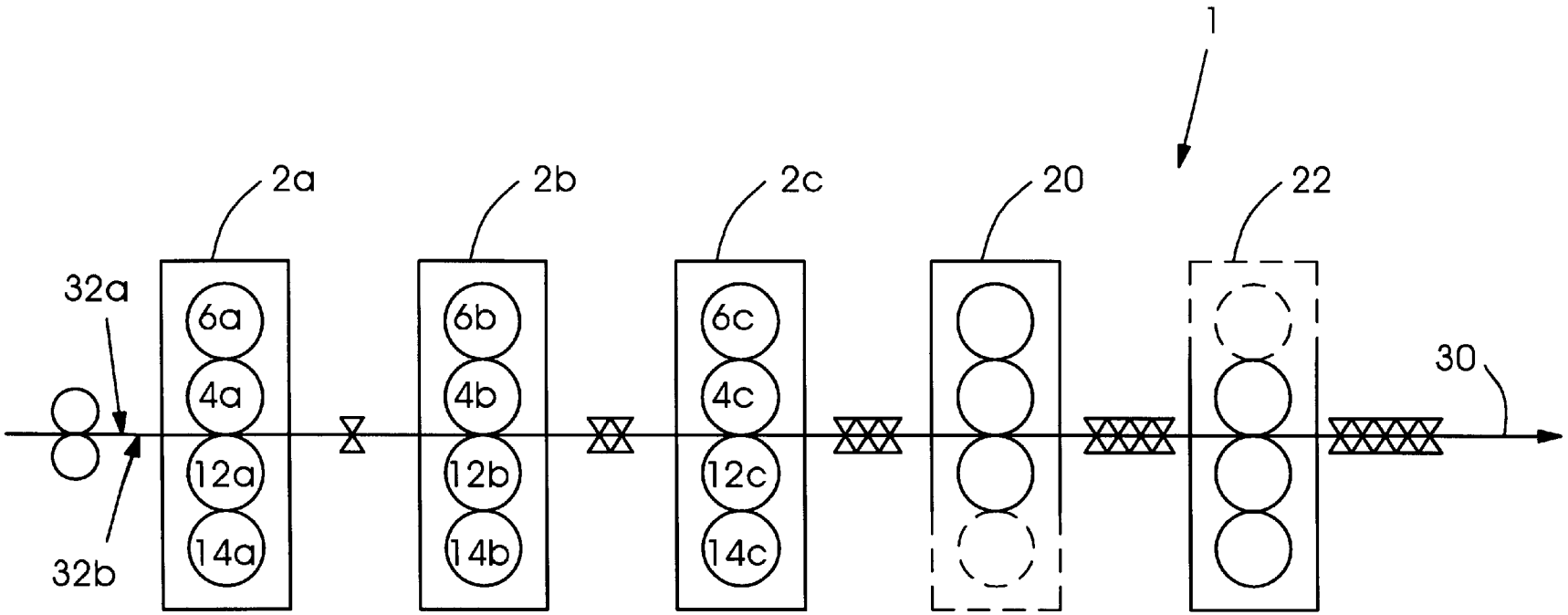
FIG. 2 shows the printing press of FIG. 1, when printing a 4/4-printing job with an additional spot color or house color on a single web in a second mode of operation.

The printing press 1 further comprises second blanket cylinders 12*a*, 12*b*, 12*c* and associated second plate cylinders 14*a*, 14*b*, 14*c* for printing a second multi-color image on a second side 16*b* of a second web 18. As seen in FIGS. 1 and 2, a first further printing unit 20 is located downstream of the blanket-to-blanket printing unit 2*d*, and a second further printing unit 22 is located downstream of the first further printing unit 20, when viewed in the traveling direction of the first and second webs 10, 18, respectively.

In a first mode of operation, hereinafter referred to as "the first mode", which is shown in FIG. 1 and in which both the first side 8*a* of the first web 10 and the second side 16*b* of the second web 18 are printed simultaneously with preferably three different colors by the blanket-to-blanket printing units 2*a*, 2*b* and 2*c*, the first web 10 is guided around the first further printing unit 20 by first guiding means 24 and is printed on its first side 8*a* and/or its second side 8*b* in the second further printing unit 22. Accordingly, the second web 18 is directly passed through the first further printing unit 20 to be printed on its first side 16*a* and/or its second side 16*b* and is afterwards guided around the second further printing unit 22 by second guiding means 26, as seen in FIG. 1.

In the preferred embodiment of the invention, the first and/or second further printing units 20, 22 are preferably prior art blanket-to-blanket printing units. In the first mode of operation in which the first and second webs 10, 18, respectively, are fed to the blanket-to-blanket printing units 2 on top of each other and are afterwards fed to the first and second further printing units 20, 22, a four color image is printed on one side of each of the webs 10 and 18 while a single color image is simultaneously printed on the other side thereof, as indicated by the wedges or keys shown in FIG. 1, wherein each of the wedges represents a respective color printed on the webs.

According to another embodiment of the invention, third guiding means 28 are positioned upstream of the blanket-to-blanket units 2*a*, 2*b* and 2*c* for diverting and guiding the incoming first and second webs 10, 18 such that they are fed to the blanket-to-blanket printing units 2*a*, 2*b*, 2*c* arranged on top of each other, as shown in FIG. 1.

The first, second and third guiding means 24, 26, 28, which are schematically indicated in the drawings, may preferably be known rollers or air bars, employed as they have been in prior art rotary printing presses for guiding a running paper web. However, the invention is not limited to rollers and air bars.

In a second mode of operation, hereinafter referred to as "the second mode", which is shown in FIG. 2, a single third paper web 30 is passed directly through the blanket-to-blanket printing units 2*a*, 2*b* and 2*c* to be printed on its first side 32*a* and its second side 32*b* with a respective multi-color image, preferably comprising three of the four colors cyan, magenta, yellow and black. After passing the last blanket-to-blanket printing unit 2*c*, the third single web 30 is directly fed to the first downstream printing unit 20 to be printed on its first and second sides 32*a* and 32*b* with an additional color, preferably a fourth color from among the colors cyan, magenta, yellow, and black. Afterward, the third single web 30 is fed to the second further printing unit 22 to be printed with an additional color or spot color on its first and/or second sides 32*a*, 32*b*, if desired.

Figure 3:
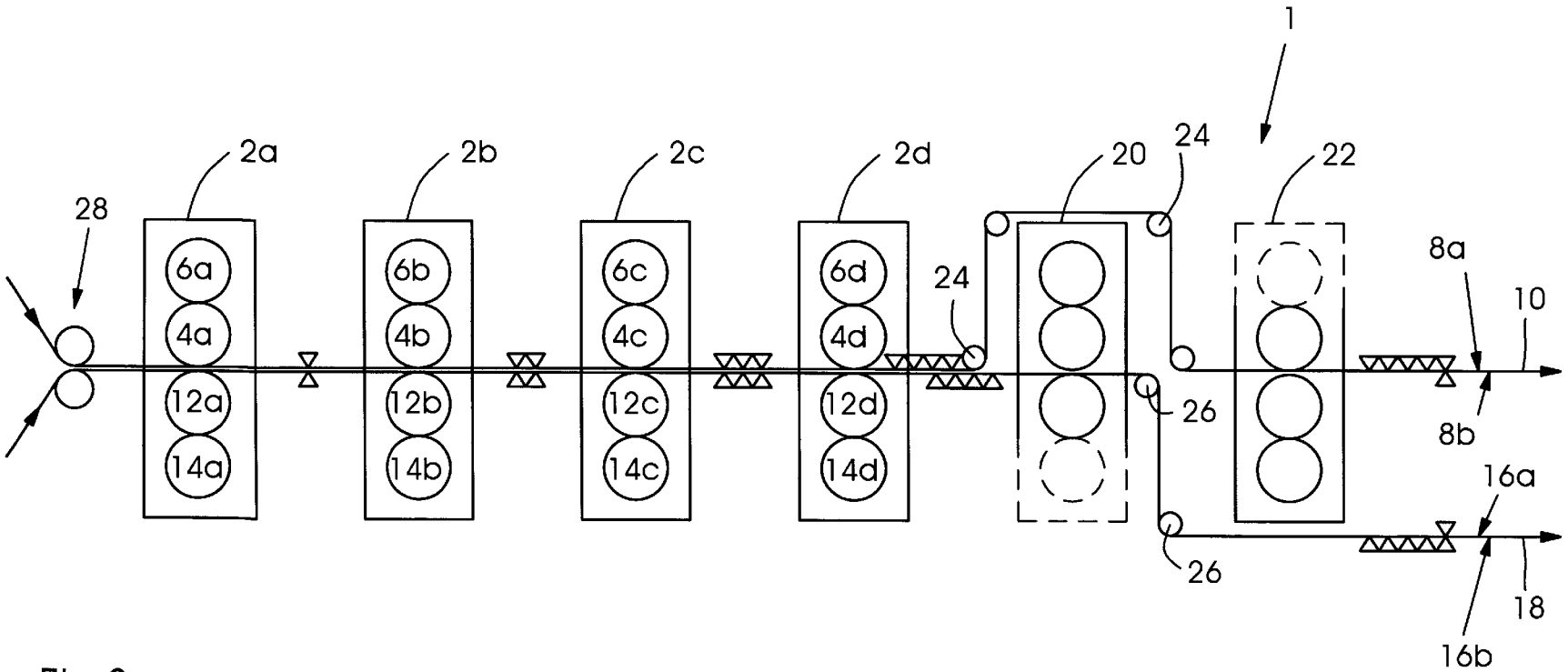
FIG. 3 shows a further embodiment of a web-fed rotary printing press according to the present invention.

Although in the preferred embodiment of the invention the first and/or second further printing units 20, 22 are known blanket-to-blanket printing units for printing images on both sides of a web, the first and/or second further printing units 20, 22 could also be known printing units for printing on only one side of the web. In this embodiment of the invention which is shown in FIG. 3, a fifth color, e.g. a spot color, may be applied to the first side 8*a* of the first web 10 and/or the second side 16*b* of the second web 18 by a printing unit 2*d* in the first mode of operation, and a sixth color, e.g. a further second spot color or varnish or the like, may be applied to the respective first and/or second sides 32*a*, 32*b* of the third single web 30 in the second mode of operation by the same printing unit 2*d*.

Although, the first web 10 and the second web 18 are preferably of the same width, the printing apparatus of this invention can also accommodate situations where the first web 10 has a smaller width than the second web 18 or where the second web 18 is narrower than the first web 10.

Moreover, the arrangement of the blanket-to-blanket printing units 2*a*, 2*b* and 2*c* and the first and second further printing units 20, 22 is not limited to the arrangement shown in FIG. 1 and FIG. 2, in which the first and second webs 10, 18 and the third single web 32 are traveling substantially horizontally through the printing units 2*a*, 2*b*, 2*c*, 20 and 22. Although, not shown, those skilled in the art will understand that it is also possible to arrange the printing units 2*a*, 2*b*, 2*c* and 20 and 22 such that the webs 10, 18 and 32 are traveling in a substantially vertical direction. Thus, those skilled in the art will understand that, when the webs 10 and 18 are described as being "on top" of one another, this merely describes a condition in which the webs 10 and 18 are arranged adjacent to one another and does not require any specific orientation with respect to the horizontal.

Pursuant to an exemplary embodiment of the invention, the first and/or second further printing unit 20, 22 can be formed as known imprinter printing units for printing changing images on the first side 16*a* of the second web 18 and/or the second side 8*b* of the first web 10 in the first mode of operation. Such imprinter printing units are known in the prior art and are therefore not described in detail.

Pursuant to a further exemplary embodiment of the invention, a method for simultaneously printing on first and a second webs 10, 18 in a web-fed rotary printing press 1, preferably a lithographic newspaper printing press, comprises the steps of arranging the first and the second webs 10, 18 on top of each other and feeding them to at least one, but preferably three, blanket-to-blanket printing units 2*a*, 2*b* and 2*c* for printing a first multi-colored image on a first side 8*a* of the first web 10 while a second colored image is printed on the second side 16*b* of the second web 18. The first and second webs 10, 18 are then separated from each other and a third image is printed on a second side 8*b* of the first web 10 and a fourth image is printed on the first side 16*a* of the second web 18. In this embodiment of the invention the third and fourth images are preferably printed in first and a second further printing units 20, 22, arranged downstream of the blanket-to-blanket printing units 2*a*, 2*b*, 2*c* and 2*d*, with the first web 10 being guided around the first further printing unit 20 and the second web 18 being guided around the second further printing unit 22.

It will be appreciated by those skilled in the art that the present invention can be embodied in other specific forms without departing from the spirit or essential characteristics thereof.

Pursuant to a further conceivable embodiment which is not shown in the drawings, the traveling direction of the webs 10 and 18 in FIG. 1 may be changed so that, in the first mode of operation, the first web 10 is initially fed to printing unit 22 while the second web 18 is fed to the printing unit 20 to be printed on one or both sides thereof, before the webs 10 and 18 are arranged on top of one another and fed to the printing units 2*c*, 2*b* and 2*a* to be printed with a multi color image as described above.

The presently disclosed embodiments are therefore considered to be illustrative and non restricted. The scope of the invention is to be limited only by the claims appended hereto, and all changes that come within the meaning and range and equivalence thereof are intended to be embraced therein.

List of Parts

1 rotary printing press
2*a* blanket-to-blanket printing unit
2*b* blanket-to-blanket printing unit
2*c* blanket-to-blanket printing unit
2*d* blanket-to-blanket printing unit (FIG. 3)
4*a* first blanket cylinder
4*b* first blanket cylinder
4*c* first blanket cylinder
4*d* first blanket cylinder (FIG. 3)
6*a* first plate cylinder
6*b* first plate cylinder
6*c* first plate cylinder
6*d* first plate cylinder (FIG. 3)
8*a* first side of first web
8*b* second side of first web
10 first web
12*a* second blanket cylinder
12*b* second blanket cylinder
12*c* second blanket cylinder
12*d* second blanket cylinder (FIG. 3)
14*a* second plate cylinder
14*b* second plate cylinder
14*c* second plate cylinder
14*d* second plate cylinder (FIG. 3)
16*a* first side of second web
16*b* second side of second web
18 second web
20 first further printing unit
22 second further printing unit
24 first guiding means
26 second guiding means
28 third guiding means
30 third single web
32*a* first side of third single web
32*b* second side of third single web

What is claimed is:

1. A web-fed rotary printing press being operative to simultaneously print a first web and second web in a first mode of operation and being operative to print a third web in a second mode of operation, comprising:

means for selectively printing either on a first side of the second web and a second side of the first web or on both sides of the third web, the means including:

first blanket-to-blanket printing unit receiving, in the first mode of operation, the first and second webs with an unprinted first side of the second web and an unprinted second side of the first web on top of each other, wherein, in the first mode of operation, the first blanket-to-blanket printing unit prints on a first side of the first web and prints on a second side of the second web and, in the second mode of operation, the third web is fed to the first blanket-to-blanket printing unit which prints on both sides of the third web;

a first further printing unit printing, in the first mode of operation, a further color on the first side of the second web;

a second further printing unit printing, in the first mode of operation, a further color on the second side of the first web;

first guiding means which, in the first mode of operation, guides the first web around the first further printing unit; and second guiding means which, in the first mode of operation, guides the second web around the second further printing unit.

2. The printing press according to claim 1, wherein the first, second and third webs travel through the printing press from an upstream portion to a downstream portion thereof, and wherein the first and second further printing units are located downstream of the first blanket-to-blanket printing unit.

3. The printing press according to claim 2, further comprising second and third blanket-to-blanket printing units located upstream of the first blanket-to-blanket printing unit, wherein, in the first mode of operation, each of the first, second and third blanket-to-blanket printing units applies a different image of a color selected from the group consisting of yellow, magenta and cyan to the first side of the first web and to the second side of the second web and wherein, in the second mode of operation, each of the first, second and third blanket-to-blanket printing units applies a different image of a color selected from the group consisting of yellow, magenta and cyan to both sides of the third web.

4. The printing press according to claim 3, wherein, in the first mode of operation, the first further printing unit applies a single color image to each of the first and second sides of the second web.

5. The printing press according to claim 4, wherein, in the first mode of operation, the first further printing unit applies a multi-color image including one of the colors selected from the group consisting of cyan, magenta, yellow black, and to the second side of the second web and applies a black image to the first side of the second web.

6. The printing press according to claim 3, wherein, in the first mode of operation, the second further printing unit applies a single color image to the first and second sides of the first web.

7. The printing press according to claim 6, wherein, in the first mode of operation, the second further printing unit applies a multi color image including one of the colors selected from the group consisting of cyan, magenta, yellow and black, to the first side of the first web and applies a black image to the second side of the first web.

8. The printing press according to claim 1, wherein the first further printing unit is an imprinter printing unit for printing, in the first mode of operation, varying images on the first side of the second web.

9. The printing press according to claim 1, wherein the second further printing unit is an imprinter printing unit for printing, in the first mode of operation, varying images on the second side of the first web.

10. The printing press according to claim 1, wherein the printing press is a newspaper printing press.

11. The printing press according to claim 1, further comprising third guiding means upstream of the first blanket-to-blanket printing unit, wherein, in the first mode of operation, the third guiding means arrange the first and second webs on top of one another before feeding the first and second webs to the first blanket-to-blanket printing unit.

12. The printing press of claim 11, wherein the third guiding means include rollers.

13. The printing press according to claim 1, wherein the first and second guiding means include rollers.

14. The printing press according to claim 1, wherein a width of the first web is smaller than a width of the second web.

15. The printing press according to claim 1, wherein a width of the second web is smaller than a width of the first web.

16. The printing press according to claim 1, wherein the first blanket-to-blanket printing unit and the first and second further printing units are arranged such that, in the first mode of operation, the first and second webs are traveling in a substantially vertical direction and, in the second mode of operation, the third web is traveling in a substantially vertical direction.

17. The printing press according to claim 1, wherein the first blanket-to-blanket printing unit and the first and second further printing units are arranged such that, in the first mode of operation, the first and second webs are traveling in a substantially horizontal direction and, in the second mode of operation, the third web is travelling in a substantially horizontal direction.

18. A method for operating a printing press having a first blanket-to-blanket printing unit, the method comprising the steps of:

in the first mode of operation:

arranging a first web and a second web with an unprinted second side of the first web and an unprinted first side of the second web on top of one another;

feeding the first and second webs arranged on top of one another to a blanket-to-blanket printing unit for printing a first colored image on a first side of the first web and a second colored image on a second side of the second web;

separating the first and second webs from each other; and printing a third image on the second side of the first web and a fourth image on the first side of the second web.

in a second mode of operation:

feeding a third web to the blanket-to-blanket printing unit for printing on both sides of the web.

19. The method according to claim 18, wherein the third image is printed in a first further printing unit arranged downstream of the blanket-to-blanket printing unit and the fourth image is printed in a second further printing unit arranged downstream of the blanket-to-blanket printing unit, whereby the first web is guided around the first further printing unit and the second web is guided around the second further printing unit.

* * * * *